US011257412B2

(12) United States Patent
Pyun et al.

(10) Patent No.: US 11,257,412 B2
(45) Date of Patent: Feb. 22, 2022

(54) DISPLAY DEVICE PERFORMING PEAK LUMINANCE DRIVING, AND METHOD OF OPERATING A DISPLAY DEVICE

(71) Applicant: SAMSUNG DISPLAY CO., LTD., Yongin-si (KR)

(72) Inventors: Ki Hyun Pyun, Gwangmyeong-si (KR); Hee Sook Park, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/088,056

(22) Filed: Nov. 3, 2020

(65) Prior Publication Data

US 2021/0319739 A1 Oct. 14, 2021

(30) Foreign Application Priority Data

Apr. 8, 2020 (KR) ..... 10-2020-0042811

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2320/0276* (2013.01); *G09G 2360/16* (2013.01)

(58) Field of Classification Search
CPC ..... G09G 2320/0276; G09G 3/2003; G09G 2300/0452; G09G 2360/16; G09G 2310/027
See application file for complete search history.

(56) References Cited

U.S. PATENT DOCUMENTS

2009/0262114 A1* 10/2009 Park ..... H04N 9/69 345/440
2014/0333684 A1* 11/2014 Marcu ..... G09G 3/3611 345/690

(Continued)

FOREIGN PATENT DOCUMENTS

KR 10-0517734 9/2005
KR 10-2011-0069325 6/2011

(Continued)

*Primary Examiner* — Muhammad N Edun
(74) *Attorney, Agent, or Firm* — F. Chau & Associates, LLC

(57) ABSTRACT

A display device includes a display panel having a plurality of pixels, a controller configured to determine a peak luminance based on a target luminance and a black duty ratio that is a ratio of a black insertion period to a sum of an image display period and the black insertion period, to determine gray-luminance information representing a plurality of luminances respectively corresponding to a plurality of gray levels based on the peak luminance and a target gamma value, and to generate gray-voltage information representing a plurality of voltage levels respectively corresponding to the plurality of gray levels based on a target white color coordinate and the gray-luminance information, a gray voltage generator configured to generate a plurality of gray voltages having the plurality of voltage levels based on the gray-voltage information, and a data driver configured to provide the plurality of gray voltages corresponding to output image data as data voltages to the plurality of pixels in the image display period, and to provide a black data voltage to the plurality of pixels in the black insertion period.

20 Claims, 12 Drawing Sheets

(56) References Cited

U.S. PATENT DOCUMENTS

| | | | | |
|---|---|---|---|---|
| 2020/0219433 | A1* | 7/2020 | Yim | G09G 3/2044 |
| 2020/0335026 | A1* | 10/2020 | Lin | G09G 3/36 |
| 2021/0005161 | A1* | 1/2021 | Lee | G06F 17/18 |

FOREIGN PATENT DOCUMENTS

| | | |
|---|---|---|
| KR | 10-1675257 | 11/2016 |
| KR | 10-2018-0060530 | 6/2018 |
| KR | 10-2019-0081830 | 7/2019 |

* cited by examiner

DISPLAY DEVICE PERFORMING PEAK LUMINANCE DRIVING, AND METHOD OF OPERATING A DISPLAY DEVICE

CROSS-REFERENCE TO RELATED APPLICATION(S)

This application claims priority under 35 USC § 119 to Korean Patent Application No. 10-2020-0042811, filed on Apr. 8, 2020 in the Korean Intellectual Property Office (KIPO), the content of which is incorporated by reference herein in its entirety.

FIELD

Exemplary embodiments of the present inventive concept relate to display devices, and more particularly to a display device performing peak luminance driving and a method of operating the display device.

DISCUSSION OF RELATED ART

When a display device, such as an organic light emitting diode (OLED) display device, displays a moving image or a motion picture, an image blur or a motion blur may occur. To reduce or eliminate the image blur or the motion picture, or to reduce a motion picture response time (MPRT) of the display device, a peak luminance driving method has been developed. In the peak luminance driving method, a black insertion period in which a black image is displayed may be inserted within a frame period, and a display panel may display an image with a peak luminance higher than a desired steady-state luminance to maintain an average luminance substantially the same as the desired steady-state luminance in the frame period.

In the peak luminance driving method, in a case where a black duty ratio that is a ratio of the black insertion period to the frame period is changed, the peak luminance should be changed according to the black duty ratio to maintain the desired average luminance. However, if the peak luminance is changed, a gamma value of the display device may be changed, and a display quality of the display device may be reduced.

SUMMARY

An exemplary embodiment provides a display device that maintains a constant gamma characteristic even if a peak luminance is changed. An exemplary embodiment provides a method of operating a display device that maintains a constant gamma characteristic even if a peak luminance is changed.

According to an exemplary embodiment, a display device includes a display panel having a plurality of pixels, a controller configured to determine a peak luminance based on a target luminance and a black duty ratio that is a ratio of a black insertion period to a sum of an image display period and the black insertion period, to determine gray-luminance information representing a plurality of luminances respectively corresponding to a plurality of gray levels based on the peak luminance and a target gamma value, and to generate gray-voltage information representing a plurality of voltage levels respectively corresponding to the plurality of gray levels based on a target white color coordinate and the gray-luminance information, a gray voltage generator configured to generate a plurality of gray voltages having the plurality of voltage levels based on the gray-voltage information, and a data driver configured to provide the plurality of gray voltages corresponding to output image data as data voltages to the plurality of pixels in the image display period, and to provide a black data voltage to the plurality of pixels in the black insertion period.

In an exemplary embodiment, the plurality of pixels may display an image with a luminance corresponding to the target gamma value in the image display period.

In an exemplary embodiment, the controller may include a peak luminance calculator configured to determine the peak luminance based on the black duty ratio and the target luminance, a gray-luminance calculator configured to determine the gray-luminance information based on the peak luminance and the target gamma value, a gray-voltage calculator configured to generate the gray-voltage information based on the target white color coordinate and the gray-luminance information, and a gamma block configured to store the gray-voltage information.

In an exemplary embodiment, the peak luminance calculator may calculate the peak luminance by using an equation, "PEAK_LUM=TGT_LUM/(1−BDR)", where PEAK_LUM represents the peak luminance, TGT_LUM represents the target luminance, and BDR represents the black duty ratio.

In an exemplary embodiment, the peak luminance calculator may receive black insertion information representing the black duty ratio from an external host.

In exemplary embodiments, the controller may further include a data analyzer configured to determine the black duty ratio by analyzing input image data, and to generate black insertion information representing the black duty ratio, and the peak luminance calculator may receive the black insertion information from the data analyzer.

In an exemplary embodiment, the gray-luminance calculator may calculate the plurality of luminances respectively corresponding to the plurality of gray levels by using an equation, "GRAY_LUM=PEAK_LUM*(GRAY/MAX_GRAY)^TGT_GAMMA", where GRAY_LUM represents the plurality of luminances respectively corresponding to the plurality of gray levels, PEAK_LUM represents the peak luminance, GRAY represents the plurality of gray levels, MAX_GRAY represents a maximum gray level, and TGT_GAMMA represents the target gamma value.

In an exemplary embodiment, each of the plurality of pixels may include a red sub-pixel, a green sub-pixel and a blue sub-pixel, and the gray-voltage calculator may determine a plurality of red voltage levels for the red sub-pixel, a plurality of green voltage levels for the green sub-pixel and a plurality of blue voltage levels for the blue sub-pixel at the plurality of gray levels based on the target white color coordinate and the gray-luminance information.

In an exemplary embodiment, the controller may further include a data-RGB color coordinate block configured to store data-RGB color coordinate information representing a plurality of red color coordinates for the red sub-pixel, a plurality of green color coordinates for the green sub-pixel and a plurality of blue color coordinates for the blue sub-pixel at a plurality of data voltage levels, and a data-RGB luminance block configured to store data-RGB luminance information representing a plurality of red luminances for the red sub-pixel, a plurality of green luminances for the green sub-pixel and a plurality of blue luminances for the blue sub-pixel at the plurality of data voltage levels.

In an exemplary embodiment, the gray-voltage calculator may determine the plurality of red voltage levels, the plurality of green voltage levels and the plurality of blue voltage levels at the plurality of gray levels based on the target white color coordinate, the gray-luminance information, the data- RGB color coordinate information and the data-RGB luminance information, and may write the gray-voltage information representing the plurality of red voltage levels, the plurality of green voltage levels and the plurality of blue voltage levels at the plurality of gray levels to the gamma block.

In an exemplary embodiment, the gray voltage generator may read the gray-voltage information from the gamma block, and may generate the plurality of gray voltages having the plurality of voltage levels represented by the gray-voltage information.

In an exemplary embodiment, the black data voltage may be one of the plurality of gray voltages corresponding to a minimum gray level.

According to an exemplary embodiment, there is provided a method of operating a display device including a plurality of pixels. In the method, a peak luminance is determined based on a target luminance and a black duty ratio that is a ratio of a black insertion period to a sum of an image display period and the black insertion period, gray-luminance information representing a plurality of luminances respectively corresponding to a plurality of gray levels is determined based on the peak luminance and a target gamma value, gray-voltage information representing a plurality of voltage levels respectively corresponding to the plurality of gray levels is generated based on a target white color coordinate and the gray-luminance information, a plurality of gray voltages having the plurality of voltage levels is generated based on the gray-voltage information, the plurality of gray voltages corresponding to output image data is provided as data voltages to the plurality of pixels in the image display period, and a black data voltage is provided to the plurality of pixels in the black insertion period.

In an exemplary embodiment, an image displayed by the plurality of pixels in the image display period may have a luminance corresponding to the target gamma value.

In an exemplary embodiment, the peak luminance may be calculated by using an equation, "PEAK_LUM=TGT_LUM/(1−BDR)", where PEAK_LUM represents the peak luminance, TGT_LUM represents the target luminance, and BDR represents the black duty ratio.

In an exemplary embodiment, black insertion information representing the black duty ratio may be received from an external host.

In an exemplary embodiment, the black duty ratio may be determined by analyzing input image data.

In an exemplary embodiment, the plurality of luminances respectively corresponding to the plurality of gray levels may be calculated by using an equation, "GRAY_LUM=PEAK_LUM*(GRAY/MAX_GRAY) ^TGT_GAMMA", where GRAY_LUM represents the plurality of luminances respectively corresponding to the plurality of gray levels, PEAK_LUM represents the peak luminance, GRAY represents the plurality of gray levels, MAX_GRAY represents a maximum gray level, and TGT_GAMMA represents the target gamma value.

In an exemplary embodiment, each of the plurality of pixels may include a red sub-pixel, a green sub-pixel and a blue sub-pixel, and a plurality of red voltage levels for the red sub-pixel, a plurality of green voltage levels for the green sub-pixel and a plurality of blue voltage levels for the blue sub-pixel at the plurality of gray levels may be determined based on the target white color coordinate and the gray-luminance information.

In an exemplary embodiment, the plurality of red voltage levels, the plurality of green voltage levels and the plurality of blue voltage levels may be determined based on the target white color coordinate, the gray-luminance information, data-RGB color coordinate information and data-RGB luminance information, the data-RGB color coordinate information may represent a plurality of red color coordinates for the red sub-pixel, a plurality of green color coordinates for the green sub-pixel and a plurality of blue color coordinates for the blue sub-pixel at a plurality of data voltage levels, and the data-RGB luminance information may represent a plurality of red luminances for the red sub-pixel, a plurality of green luminances for the green sub-pixel and a plurality of blue luminances for the blue sub-pixel at the plurality of data voltage levels.

As described above, in a display device and a method of operating the display device according to exemplary embodiments, a peak luminance may be determined based on a black duty ratio and a target luminance, gray-luminance information may be determined based on the peak luminance and a target gamma value, gray-voltage information may be generated based on a target white color coordinate and the gray-luminance information, and a plurality of gray voltages may be generated based on the gray-voltage information. Accordingly, even if the peak luminance is changed, the display device according to exemplary embodiments may maintain a constant gamma characteristic.

According to an exemplary embodiment, a display controller includes: a gamma controller circuit having a peak luminance sub-circuit, a grayscale luminance sub-circuit coupled to the peak luminance sub-circuit, and a grayscale voltage sub-circuit coupled to the grayscale luminance sub-circuit; and a gamma storage circuit coupled to the grayscale voltage sub-circuit of the gamma controller circuit.

In an exemplary embodiment, the display controller may include: a data color coordinate sub-circuit coupled to the grayscale voltage sub-circuit; and a data luminance sub-circuit coupled to the grayscale voltage sub-circuit. In an exemplary embodiment, the display controller may include: a data analyzer circuit coupled to the gamma controller circuit. In an exemplary embodiment, the display controller may include: a grayscale voltage generator circuit coupled to the gamma storage circuit.

In an exemplary embodiment, the gamma controller circuit may be configured to receive black insertion information based on input image data, and provide grayscale voltage information to the gamma storage circuit. In an exemplary embodiment, the gamma storage circuit may include a lookup table having, for each of a plurality of grayscale voltage inputs, a plurality of different grayscale voltage outputs for a corresponding plurality of different peak luminance values.

BRIEF DESCRIPTION OF THE DRAWINGS

Illustrative, non-limiting exemplary embodiments will be more clearly understood from the following detailed description when taken in conjunction with the accompanying drawings, in which.

DETAILED DESCRIPTION

Hereinafter, exemplary embodiments of the present inventive concept will be explained in detail with reference to the accompanying drawings.

Figure 1:
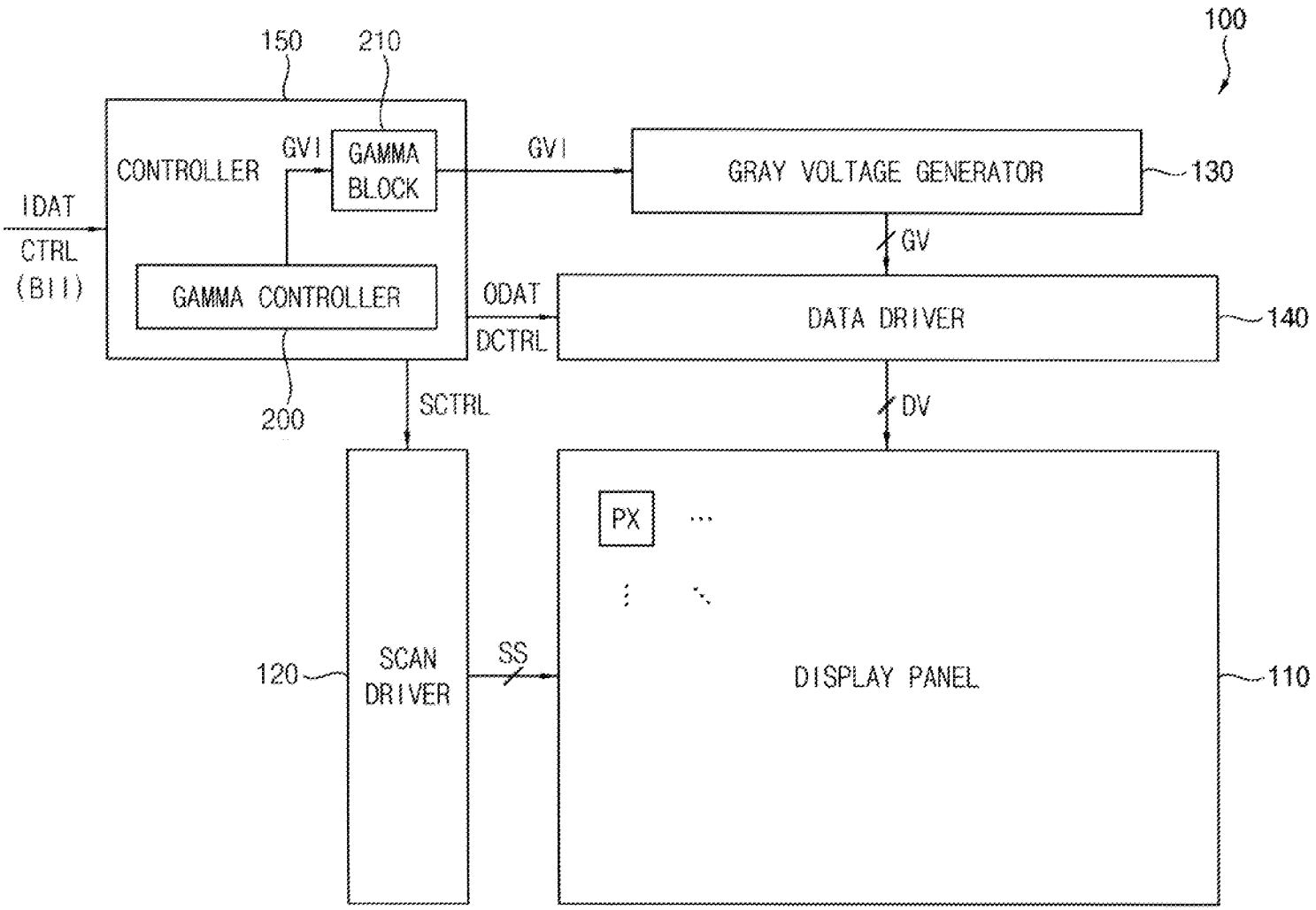
FIG. 1 is a block diagram illustrating a display device according to an exemplary embodiment.
Figure 2:
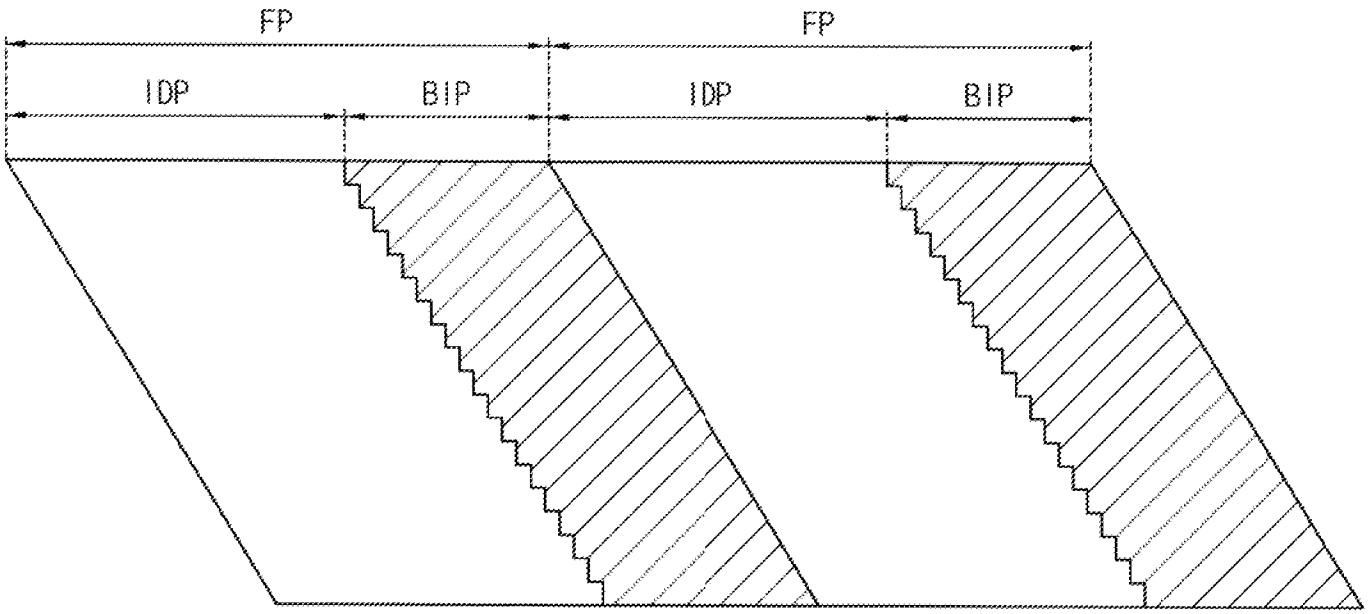
FIG. 2 is a graphical diagram for describing an example of an operation of a display device according to an exemplary embodiment.
Figure 3:
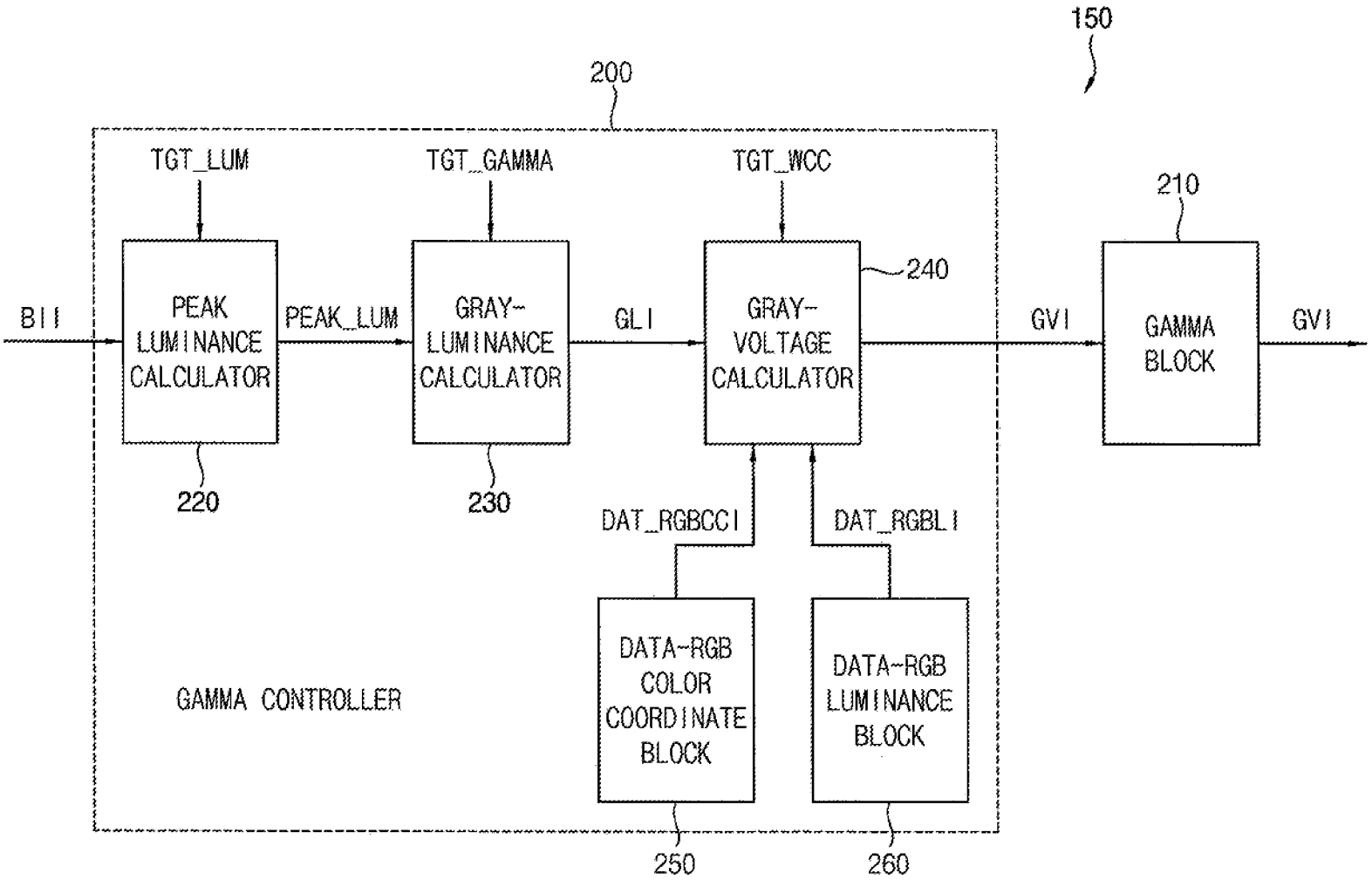
FIG. 3 is a block diagram illustrating an example of a controller included in a display device according to an exemplary embodiment.
Figure 4:
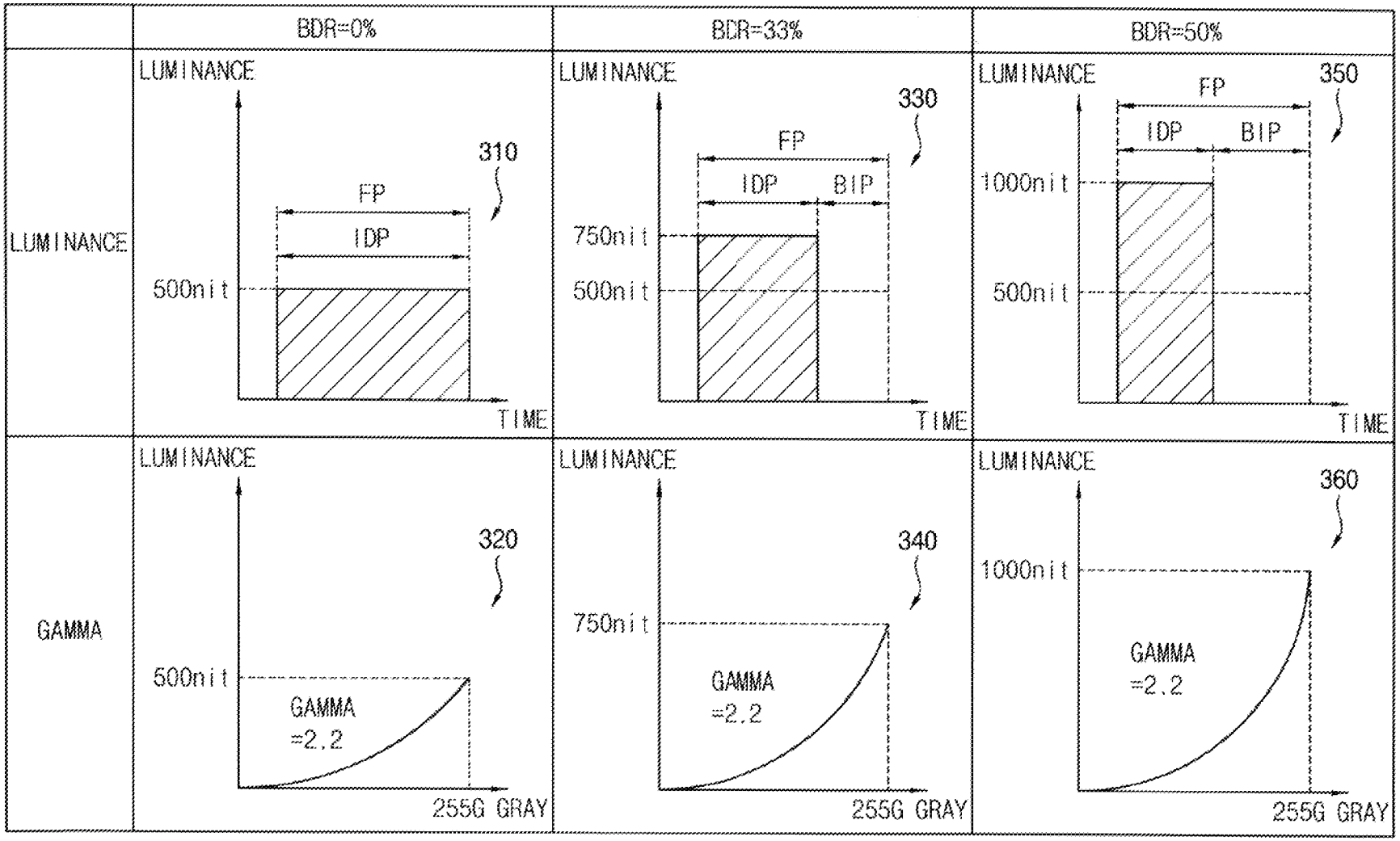
FIG. 4 is a graphical diagram for describing examples of peak luminances and gamma characteristics of a display device according to an exemplary embodiment when the display device operates with a black duty ratio of about 0%, a black duty ratio of about 30% and a black duty ratio of about 50%.

FIG. 1 illustrates a display device according to an exemplary embodiment, FIG. 2 shows an example of an operation of a display device according to an exemplary embodiment, FIG. 3 illustrates an example of a controller included in a display device according to an exemplary embodiment, and FIG. 4 shows examples of peak luminance and gamma characteristics of a display device according to an exemplary embodiment when the display device operates with a black duty ratio of about 0%, a black duty ratio of about 30% and a black duty ratio of about 50%.

Referring to FIG. 1, a display device 100 according to an exemplary embodiment may include a display panel 110 having a plurality of pixels PX, a scan driver 120 providing scan signals SS to the plurality of pixels PX, a gray voltage generator 130 generating a plurality of gray voltages GV, a data driver 140 providing data voltages DV to the plurality of pixels PX based on the plurality of gray voltages GV, and a controller 150 controlling an operation of the display device 100.

The display panel 110 may include a plurality of data lines, a plurality of scan lines, and the plurality of pixels PX coupled to the plurality of data lines and the plurality of scan lines. In an exemplary embodiment, the display panel 110 may be an organic light emitting diode (OLED) display panel where each pixel PX includes an OLED. For example, each pixel PX may have, but is not limited to a three-transistor one-capacitor (3T1C) structure including a storage capacitor, a switching transistor transferring the data voltage DV to the storage capacitor, a driving transistor generating a driving current based on the data voltage DV stored in the storage capacitor, the OLED emitting light based on the driving current, and an initializing transistor connecting an anode of the OLED to an initialization line (or a sensing line).

In another exemplary embodiment, each pixel PX may include a switching transistor and a liquid crystal capacitor coupled to the switching transistor, and the display panel 110 may be a liquid crystal display (LCD) panel. In still another exemplary embodiment, each pixel PX may include an inorganic light emitting diode or a quantum dot light emitting diode, and the display panel 110 may be an inorganic light emitting diode display panel or a quantum dot light emitting diode display panel. However, the display panel 110 is not limited to the OLED display panel, the LCD panel, the inorganic light emitting diode display panel and/or the quantum dot light emitting diode display panel, and may be any other suitable display panel.

The scan driver 120 may generate the scan signals SS based on a scan control signal SCTRL received from the controller 150, and may sequentially provide the scan signals SS to the plurality of pixels PX on a row-by-row basis. In an exemplary embodiment, the scan control signal SCTRL may include, but is not limited to, a scan start signal and a scan clock signal. In an exemplary embodiment, the scan driver 120 may be integrated or formed in a peripheral portion of the display panel 110. In another exemplary embodiment, the scan driver 120 may be implemented with one or more integrated circuits.

The gray voltage generator 130 may read gray-voltage information GVI representing a plurality of voltage levels respectively corresponding to a plurality of gray levels from a gamma block 210 (or a gamma lookup table), and may generate the plurality of gray voltages GV having the plurality of voltage levels based on the gray-voltage information GVI. In an exemplary embodiment, each pixel PX may include a red sub-pixel, a green sub-pixel and a blue sub-pixel, the gray-voltage information GVI of the gamma block 210 may represent a red voltage level for the red sub-pixel, a green voltage level for the green sub-pixel and a blue voltage level for the blue sub-pixel at each gray level, and the gray voltage generator 130 may generate, as the plurality of gray voltages GV, red gray voltages for the red sub-pixel, green gray voltages for the green sub-pixel and blue gray voltages for the blue sub-pixel. Further, in an exemplary embodiment, the gray-voltage information GVI of the gamma block 210 may represent the plurality of voltage levels corresponding to the entire range of grayscale or gray levels (e.g., 256 gray levels from a $0^{th}$-gray level to a $255^{th}$-gray level), and the gray voltage generator 130 may generate the plurality of gray voltages GV over the entire range of gray levels based on the gray-voltage information GVI. In another exemplary embodiment, the gray-voltage information GVI of the gamma block 210 may represent the plurality of voltage levels corresponding to reference gray levels that are a portion of the entire range of gray levels, and the gray voltage generator 130 may generate the gray voltages GV having the plurality of voltage levels represented by the gray-voltage information GVI with respect to the reference gray levels, and may generate the gray voltages GV at gray levels between the reference gray levels by dividing the gray voltages GV at the reference gray levels. Further, in an exemplary embodiment, the gray voltage generator 130 may be included in the data driver 140. In another exemplary embodiment, the gray voltage generator 130 may be located outside the data driver 140.

The data driver 140 may receive output image data ODAT and a data control signal DCTRL from the controller 150, may receive the plurality of gray voltages GV from the gray voltage generator 130, and may provide the plurality of gray voltages GV corresponding to the output image data ODAT as the data voltages DV to the plurality of pixels PX through the plurality of data lines in response to the data control signal DCTRL. In an exemplary embodiment, the data control signal DCTRL may include, but is not limited to, an output data enable signal, a horizontal start signal and/or a load signal. In an exemplary embodiment, each frame period of the display device 100 may include an image display period in which a normal image is displayed and a black insertion period in which a black image is displayed, and the data driver 140 may provide the plurality of gray voltages GV corresponding to the output image data ODAT as the data voltages DV to the plurality of pixels PX in the image display period, and may provide a black data voltage to the plurality of pixels PX in the black insertion period. For example, the black data voltage may be a gray voltage corresponding to a minimum gray level (e.g., the $0^{th}$-gray level) among the plurality of gray voltages GV. In an exemplary embodiment, the data driver 140 and the controller 150 may be implemented with a single integrated circuit, and the single integrated circuit may be referred to as a timing controller embedded data driver (TED). In another exemplary embodiment, the data driver 140 and the controller 150 may be implemented with separate integrated circuits.

The controller 150 (e.g., a timing controller (TCON)) may receive input image data IDAT and a control signal CTRL from an external host processor (e.g., a graphics processing unit (GPU) and/or a graphics card). In an exemplary embodiment, the input image data IDAT may be, but is not limited to, RGB image data including red image data, green image data and blue image data. The control signal CTRL may include black insertion information BII representing whether the black insertion period is inserted within the frame period, and/or representing a black duty ratio. In an exemplary embodiment, the control signal CTRL may further include, but is not limited to, a vertical synchronization signal, a horizontal synchronization signal, a master clock signal, a data enable signal, or the like. The controller 150 may generate the output image data ODAT, the data control signal DCTRL and the scan control signal SCTRL based on the input image data IDAT and the control signal CTRL. The controller 150 may control an operation of the data driver 140 by providing the output image data ODAT and the data control signal DCTRL to the data driver 140, and may control an operation of the scan driver 120 by providing the scan control signal SCTRL to the scan driver 120.

To reduce or eliminate an image blur of a motion picture, or to reduce a motion picture response time (MPRT) of the display device 100, the display device 100 according to an exemplary embodiment may perform peak luminance driving. In an exemplary embodiment, the display device 100 may insert the black insertion period in which the black image is displayed within each frame period, and may display an image with a peak luminance higher than a desired steady-state luminance in the image display period within each frame period to maintain an average luminance substantially the same as the desired steady-state luminance. For example, as illustrated in FIG. 2, each frame period FP, shown here for a plurality of pixel rows but not limited thereto, may include the image display period IDP in which the normal image is displayed and the black insertion period BIP in which the black image is displayed. The data driver 140 may provide the data voltages DV to the plurality of pixels PX to display the normal image in the image display period IDP, and may provide the black data voltage to the plurality of pixels PX to display the black image in the black insertion period BIP. In an exemplary embodiment, the data driver 140 may provide the data voltages DV to the plurality of pixels PX on a pixel row-by-pixel row basis in the image display period IDP, and may provide the black data voltage to the plurality of pixels PX on a unit of a plurality of pixel rows (e.g., eight pixel rows) in the black insertion period BIP. In other example embodiments, the data driver 140 may provide the black data voltage to the plurality of pixels PX on the pixel row-by-pixel row basis in the black insertion period BIP.

In a case where the black insertion period BIP is inserted, or in a case where the image display period IDP is decreased, an average luminance of the display device 100 in each frame period FP may be reduced. To prevent excessive reduction of the average luminance, or to maintain the average luminance, the display device 100 may display the image with the peak luminance in the image display period IDP, and the peak luminance may be higher than a steady-state luminance of the display device 100 in a case where the black insertion period BIP is not inserted. For example, as the black insertion period BIP increases, or as the image display period IDP decreases, the display device 100 may increase the peak luminance in the image display period IDP. For example, if the steady-state luminance in the case where the black insertion period BIP is not inserted is about 500 nit, and the black duty ratio, or a ratio of the black insertion period BIP to the frame period FP (or a sum of the image display period IDP and the black insertion period BIP) is about 50%, the image may be displayed with the peak luminance of about 1,000 nit in the image display period IDP to maintain the average luminance of about 500 nit in the frame period FP.

In a display device performing peak luminance driving, gamma tuning might be performed such that the display device has a gamma characteristic corresponding to a target gamma value at a single peak luminance (e.g., a maximum peak luminance). In this case, as the peak luminance of the display device decreases from the maximum peak luminance at which the gamma tuning is performed, a gamma value of the display device may decrease compared with the target gamma value. For example, in a case where the gamma tuning is performed with the target gamma value of about 2.2 at the maximum peak luminance of about 1,000 nit corresponding to a black duty ratio of about 50%, the display device may have a gamma value of about 2.0 at a peak luminance of about 750 nit corresponding to a black duty ratio of about 33%, and may have a gamma value of about 1.5 at a peak luminance of about 500 nit corresponding to a black duty ratio of about 0%. Accordingly, in this display device performing peak luminance driving, if the peak luminance is changed, the gamma value may be changed, and a display quality may be affected.

However, in the display device 100 according to an exemplary embodiment, the controller 150 may include a gamma controller 200 generating the gray-voltage information GVI corresponding to the peak luminance, and the gamma block 210 storing the gray-voltage information GVI generated by the gamma controller 200. The gamma controller 200 may determine the peak luminance based on a black duty ratio and a target luminance, may determine gray-luminance information based on the peak luminance and a target gamma value, and may generate the gray-voltage information GVI based on a target white color coordinate and the gray-luminance information. The gamma controller 200 may write the gray-voltage information GVI to the gamma block 210. Accordingly, even if the peak luminance is changed, the display device 100 according to an exemplary embodiment may display an image with a luminance corresponding to a constant gamma value, or the target gamma value in the image display period IDP. To perform these operations, as illustrated in FIG. 3, the controller 150 of the display device 100 according to an exemplary embodiment may include a peak luminance calculator 220, a gray-luminance calculator 230, a gray-voltage calculator 240 and the gamma block 210. In an exemplary embodiment, as illustrated in FIG. 3, the controller 150 may further include a data-RGB color coordinate block 250 and a data-RGB luminance block 260.

The peak luminance calculator 220 may determine the peak luminance PEAK_LUM based on the target luminance TGT_LUM and the black duty ratio that is a ratio of the black insertion period BIP to the frame period FP, or the ratio of the black insertion period BIP to the sum of the image display period IDP and the black insertion period BIP. In an exemplary embodiment, the peak luminance calculator 220 may receive the black insertion information BII representing the black duty ratio from the external host. Further, in an exemplary embodiment, the peak luminance calculator 220 may calculate the peak luminance PEAK_LUM by using an equation, "PEAK_LUM=TGT_LUM/(1−BDR)". Here, PEAK_LUM may represent the peak luminance, TGT_LUM may represent the target luminance, and BDR may represent the black duty ratio. For example, in a case where the target luminance TGT_LUM is about 500 nit, and the black duty ratio is about 33%, the peak luminance calculator 220 may determine the peak luminance PEAK_LUM as "500/(1−0.33)", or about 750 nit. In another example, in a case where the target luminance TGT_LUM is about 500 nit, and the black duty ratio is about 50%, the peak luminance calculator 220 may determine the peak luminance PEAK_LUM as "500/(1−0.5)", or about 1,000 nit.

The gray-luminance calculator 230 may determine the gray-luminance information GLI representing a plurality of luminances respectively corresponding to a plurality of gray levels based on the peak luminance PEAK_LUM and the target gamma value TGT_GAMMA. In an exemplary embodiment, the gray-luminance calculator 230 may calculate the plurality of luminances respectively corresponding to the plurality of gray levels by using an equation, "GRAY_LUM=PEAK_LUM*(GRAY/MAX_GRAY) ^TGT_GAMMA". Here, GRAY_LUM may represent the plurality of luminances respectively corresponding to the plurality of gray levels, PEAK_LUM may represent the peak luminance, GRAY may represent the plurality of gray levels, MAX_GRAY may represent a maximum gray level, and TGT_GAMMA may represent the target gamma value. For example, in a case where the peak luminance PEAK_LUM is about 750 nit, the maximum gray level is a 255-gray level, and the target gamma value TGT_GAMMA is about 2.2, a luminance corresponding to a 150-gray level may be "750*(150/255)^2.2", or about 233 nit. In an exemplary embodiment, the gray-luminance calculator 230 may generate the gray-luminance information GLI representing the plurality of luminances corresponding to the entire range of gray levels (e.g., 256 gray levels from a $0^{th}$-gray level to a $255^{th}$-gray level). In another exemplary embodiment, the gray-luminance calculator 230 may generate the gray-luminance information GLI representing the plurality of luminances corresponding to reference gray levels that are a portion of the entire range of gray levels.

The gray-voltage calculator 240 may generate the gray-voltage information GVI representing a plurality of voltage levels respectively corresponding to the plurality of gray levels based on the target white color coordinate TGT_WCC and the gray-luminance information GLI, and may write the gray-luminance information GLI to the gamma block 210. In an exemplary embodiment, the gray-voltage calculator 240 may generate the gray-voltage information GVI representing the plurality of voltage levels corresponding to the entire range of gray levels. In another exemplary embodiment, the gray-voltage calculator 240 may generate the gray-voltage information GVI representing the plurality of voltage levels corresponding to the reference gray levels.

In an exemplary embodiment, each pixel PX may include the red sub-pixel, the green sub-pixel and the blue sub-pixel, and the gray-voltage calculator 240 may determine a plurality of red voltage levels for the red sub-pixel, a plurality of green voltage levels for the green sub-pixel and a plurality of blue voltage levels for the blue sub-pixel at the plurality of gray levels based on the target white color coordinate TGT_WCC and the gray-luminance information GLI. In an exemplary embodiment, the data-RGB color coordinate block 250 may store data-RGB color coordinate information DAT_RGBCCI representing a plurality of red color coordinates for the red sub-pixel, a plurality of green color coordinates for the green sub-pixel and a plurality of blue color coordinates for the blue sub-pixel at a plurality of data voltage levels (having a regular interval, for example an interval of about 0.01V), the data-RGB luminance block 260 may store data-RGB luminance (or luminous efficiency) information DAT_RGBLI representing a plurality of red luminances (or red luminous efficiencies) for the red sub-pixel, a plurality of green luminances (or green luminous efficiencies) for the green sub-pixel and a plurality of blue luminances (or blue luminous efficiencies) for the blue sub-pixel at the plurality of data voltage levels, and the gray-voltage calculator 240 may determines the plurality of red voltage levels, the plurality of green voltage levels and the plurality of blue voltage levels at the plurality of gray levels based on the target white color coordinate TGT_WGC, the gray-luminance information GLI, the data-RGB color coordinate information DAT_RGBCCI and the data-RGB luminance information DAT_RGBLI, and may write the gray-voltage information GVI representing the plurality of red voltage levels, the plurality of green voltage levels and the plurality of blue voltage levels at the plurality of gray levels to the gamma block 210. For example, the gray-voltage calculator 240 may determine a ratio of a red voltage level, a green voltage level and a blue voltage level having a color coordinate represented by the target white color coordinate TGT_WGC at each gray level based on the target white color coordinate TGT_WGC and the data-RGB color coordinate information DAT_RGBCCI, and may determine the red voltage level, the green voltage level and the blue voltage level having a luminance represented by the gray-luminance information GLI while maintaining the ratio at each gray level based on the gray-luminance information GLI and the data-RGB luminance information DAT_RGBLI.

The gray voltage generator 130 may read the gray-voltage information GVI from the gamma block 210, and may generate the plurality of gray voltages GV having the plurality of voltage levels represented by the gray-voltage information GVI. The data driver 140 may provide the plurality of gray voltages GV corresponding to the output image data ODAT as the data voltages DV to the plurality of pixels PX in the image display period IDP. In the display device 100 according to an exemplary embodiment, since the gray-voltage information GVI is generated based on the current peak luminance PEAK_LUM, the plurality of pixels PX may display an image with a luminance corresponding to the target gamma value TGT_GAMMA in the image display period IDP even if the peak luminance PEAK_LUM is changed. Further, the data driver 140 may provide the black data voltage to the plurality of pixels PX in the black insertion period BIP. In some example embodiments, the black data voltage may be a gray voltage GV corresponding to a minimum gray level (e.g., the $0^{th}$-gray level) among the plurality of gray voltages GV.

For example, in a case where the black insertion information BII represents a black duty ratio BDR of about 0%, as represented by 310 of FIG. 4, the frame period FP may have only the image display period IDP, and the peak luminance PEAK_LUM may be about 500 nit. In this case, since the gray-voltage information GVI is generated corresponding to the peak luminance PEAK_LUM of about 500 nit, as represented by 320 of FIG. 4, the plurality of gray voltages GV generated by the gray voltage generator 130 based on the gray-voltage information GVI may correspond to the target gamma value TGT_GAMMA, for example a gamma value of about 2.2. Further, in a case where the black insertion information BII represents a black duty ratio BDR of about 33%, as represented by 330 of FIG. 4, the frame period FP may have the image display period IDP corresponding to about ⅔ of the frame period FP and the black insertion period BIP corresponding to about ⅓ of the frame period FP, and the peak luminance PEAK_LUM in the image display period IDP may be about 750 nit. In this case, since the gray-voltage information GVI is generated corresponding to the peak luminance PEAK_LUM of about 750 nit, as represented by 340 of FIG. 4, the plurality of gray voltages GV generated by the gray voltage generator 130 based on the gray-voltage information GVI may correspond to the target gamma value TGT_GAMMA, for example the gamma value of about 2.2. Further, in a case where the black insertion information BII represents a black duty ratio BDR of about 50%, as represented by 350 of FIG. 4, the frame period FP may have the image display period IDP corresponding to about ½ of the frame period FP and the black insertion period BIP corresponding to about ½ of the frame period FP, and the peak luminance PEAK_LUM in the image display period IDP may be about 1,000 nit. In this case, since the gray-voltage information GVI is generated corresponding to the peak luminance PEAK_LUM of about 1,000 nit, as represented by 360 of FIG. 4, the plurality of gray voltages GV generated by the gray voltage generator 130 based on the gray-voltage information GVI may correspond to the target gamma value TGT_GAMMA, for example the gamma value of about 2.2.

As described above, display device 100 according to an exemplary embodiment may determine the peak luminance PEAK_LUM based on the black duty ratio and the target luminance TGT_LUM, may determine the gray-luminance information GLI based on the peak luminance PEAK_LUM and the target gamma value TGT_GAMMA, may generate the gray-voltage information GVI based on the target white color coordinate TGT_WCC and the gray-luminance information GLI, and may generate the plurality of gray voltages GV based on the gray-voltage information GVI. Accordingly, even if the peak luminance PEAK_LUM is changed, the display device 100 according to an exemplary embodiment may have a constant gamma characteristic, or a gamma characteristic of the constant target gamma value TGT_GAMMA.

According to an exemplary embodiment, a display controller 150 includes a gamma controller circuit 200 having a peak luminance sub-circuit 220, a grayscale luminance sub-circuit 230 coupled to the peak luminance sub-circuit, and a grayscale voltage sub-circuit 240 coupled to the grayscale luminance sub-circuit; and a gamma storage circuit 210 coupled to the grayscale voltage sub-circuit of the gamma controller circuit.

In an exemplary embodiment, the display controller 150 may include: a data color coordinate sub-circuit 250 coupled to the grayscale voltage sub-circuit; and a data luminance sub-circuit 260 coupled to the grayscale voltage sub-circuit. In an exemplary embodiment, the display controller may include: a grayscale voltage generator circuit 130 coupled to the gamma storage circuit 210.

In an exemplary embodiment, the gamma controller circuit 200 may be configured to receive black insertion information based on input image data, and provide grayscale voltage information to the gamma storage circuit 210. In an exemplary embodiment, the gamma storage circuit 210 may include a lookup table having, for each of a plurality of grayscale voltage inputs, a plurality of different grayscale voltage outputs for a corresponding plurality of different peak luminance values.

Figure 5:
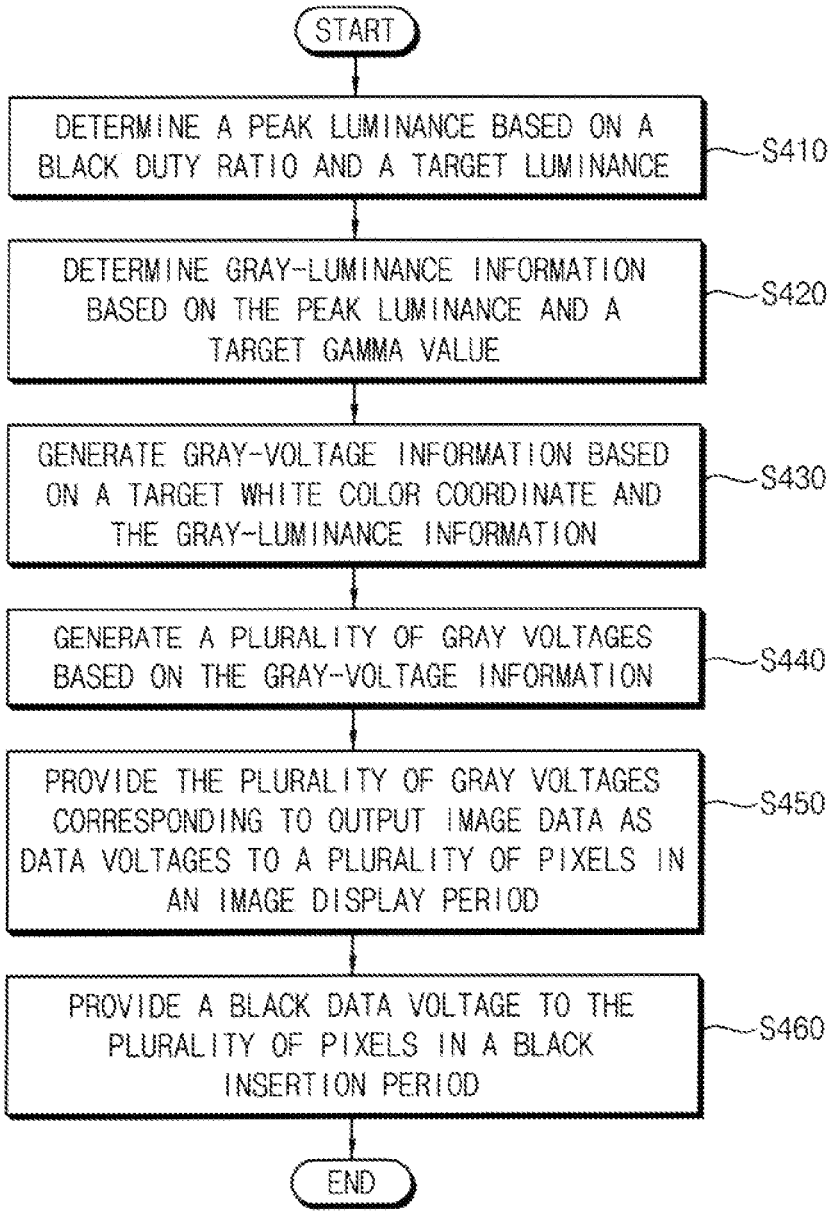
FIG. 5 is a flowchart diagram illustrating a method of operating a display device according to an exemplary embodiment.
Figure 6:
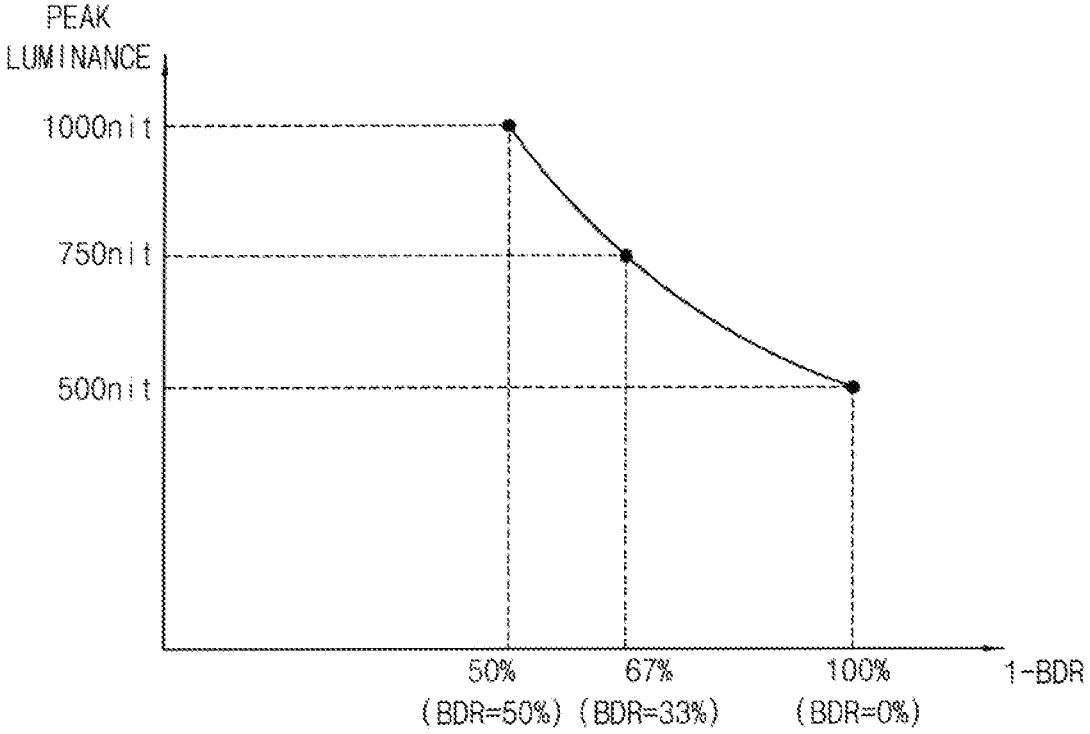
FIG. 6 is a graphical diagram for describing an example of a peak luminance according to a black duty ratio.
Figure 7:
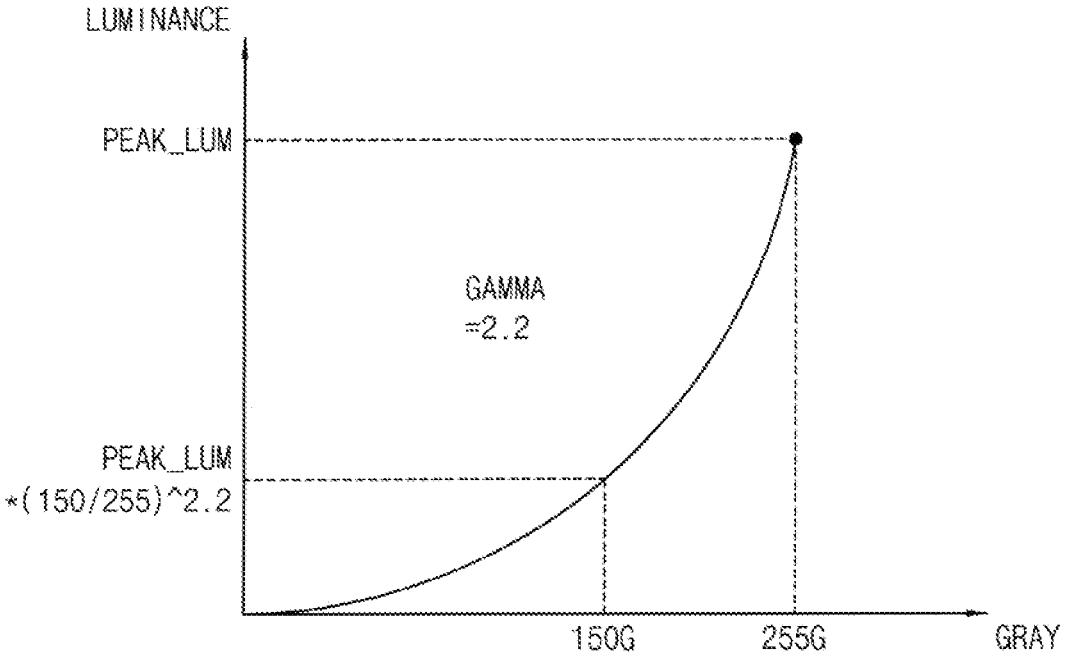
FIG. 7 is a graphical diagram for describing an example where gray-luminance information is determined according to a peak luminance.
Figure 8:
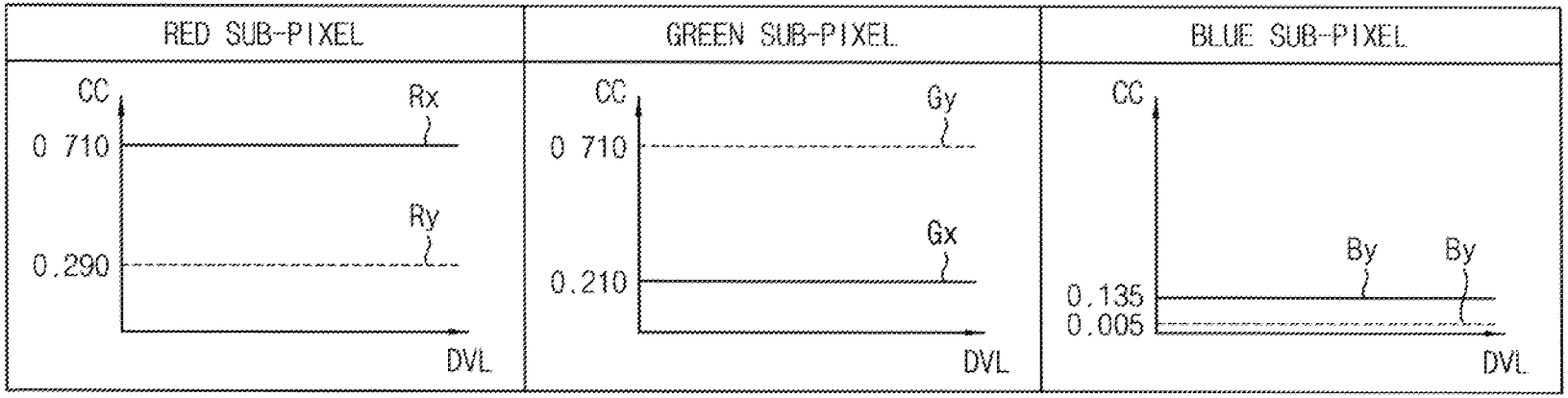
FIG. 8 is a graphical diagram for describing an example of data-RGB color coordinate information stored in a display device according to an exemplary embodiment.
Figure 9:
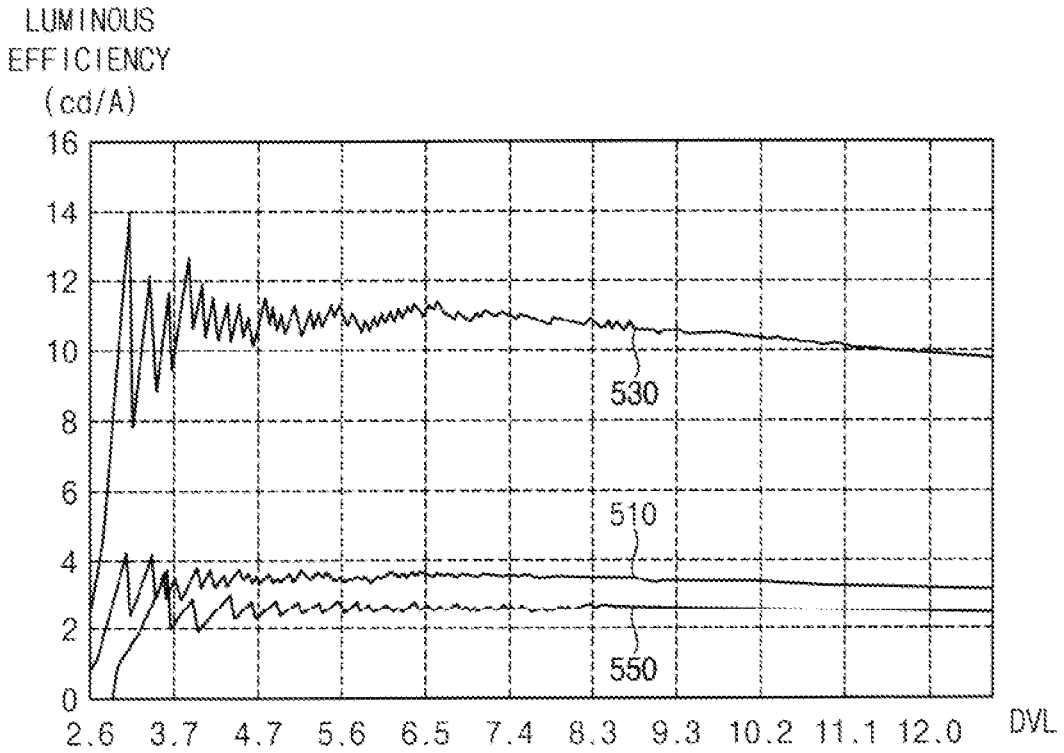
FIG. 9 is a graphical diagram for describing an example of data-RGB luminance information stored in a display device according to an exemplary embodiment.

FIG. 5 illustrates a method of operating a display device according to an exemplary embodiment, FIG. 6 shows an example of a peak luminance according to a black duty ratio, FIG. 7 shows an example where gray-luminance information is determined according to a peak luminance, FIG. 8 shows an example of data-RGB color coordinate information stored in a display device according to an exemplary embodiment, and FIG. 9 shows an example of data-RGB luminance information stored in a display device according to an exemplary embodiment.

Referring to FIGS. 1, 3 and 5, in a method of operating a display device 100 including a plurality of pixels PX, a peak luminance calculator 220 may receive black insertion information BII representing a black duty ratio, which is a ratio of a black insertion period to a sum of an image display period and the black insertion period, from an external host, and may determine a peak luminance PEAK_LUM based on the black duty ratio and a target luminance TGT_LUM at step S410. In an exemplary embodiment, the peak luminance calculator 220 may calculate the peak luminance PEAK_LUM by using an equation, "PEAK_LUM=TGT_LUM/(1−BDR)", where PEAK_LUM may represent the peak luminance, TGT_LUM may represent the target luminance, and BDR may represent the black duty ratio. For example, as illustrated in FIG. 6, in a case where the target luminance TGT_LUM is about 500 nit, and the black duty ratio BDR is about 0%, the peak luminance calculator 220 may determine the peak luminance PEAK_LUM as "500/(1−0)", or about 500 nit. In another example, in a case where the target luminance TGT_LUM is about 500 nit, and the black duty ratio BDR is about 33%, the peak luminance calculator 220 may determine the peak luminance PEAK_LUM as "500/(1−0.33)", or about 750 nit. In still another example, in a case where the target luminance TGT_LUM is about 500 nit, and the black duty ratio BDR is about 50%, the peak luminance calculator 220 may determine the peak luminance PEAK_LUM as "500/(1−0.5)", or about 1,000 nit.

A gray-luminance calculator 230 may determine gray-luminance information GLI representing a plurality of luminances respectively corresponding to a plurality of gray levels based on the peak luminance PEAK_LUM and a target gamma value TGT_GAMMA at step S420. In an exemplary embodiment, as illustrated in FIG. 4, the gray-luminance calculator 230 may calculate the plurality of luminances respectively corresponding to the plurality of gray levels by using an equation, "GRAY_LUM=PEAK_LUM*(GRAY/MAX_GRAY) ^TGT_GAMMA", where GRAY_LUM may represent the plurality of luminances respectively corresponding to the plurality of gray levels, PEAK_LUM may represent the peak luminance, GRAY may represent the plurality of gray levels, MAX_GRAY may represent a maximum gray level, and TGT_GAMMA may represent the target gamma value. For example, in a case where the maximum gray level is a 255-gray level 255G and the target gamma value TGT_GAMMA is about 2.2, a luminance corresponding to a 150-gray level 150G may be "PEAK_LUM*(150/255) ^2.2" (nit).

A gray-voltage calculator 240 may generate gray-voltage information GVI representing a plurality of voltage levels respectively corresponding to the plurality of gray levels based on a target white color coordinate TGT_WCC and the gray-luminance information GLI at step S430. In an exemplary embodiment, each pixel PX may include a red sub-pixel, a green sub-pixel and a blue sub-pixel, and the gray-voltage calculator 240 may generate the gray-voltage information GVI representing a plurality of red voltage levels for the red sub-pixel, a plurality of green voltage levels for the green sub-pixel and a plurality of blue voltage levels for the blue sub-pixel at the plurality of gray levels based on the target white color coordinate TGT_WCC, the gray-luminance information GLI, data-RGB color coordinate information DAT_RGBCCI and data-RGB luminance information DAT_RGBLI.

In an exemplary embodiment, a data-RGB color coordinate block 250 may store the data-RGB color coordinate information DAT_RGBCCI representing a plurality of red color coordinates for the red sub-pixel, a plurality of green color coordinates for the green sub-pixel and a plurality of blue color coordinates for the blue sub-pixel at a plurality of data voltage levels (having a regular interval, for example an interval of about 0.01V). For example, as illustrated in FIG. 8, the data-RGB color coordinate information DAT_RGBCCI may include, as the red color coordinates CC, an X-color coordinate Rx of about 0.710 and an Y-color coordinate Ry of about 0.290 that are constant according to a data voltage level DVL with respect to the red sub-pixel, may include, as the green color coordinates CC, an X-color coordinate Gx of about 0.210 and an Y-color coordinate Gy of about 0.710 that are constant according to the data voltage level DVL with respect to the green sub-pixel, and may include, as the blue color coordinates CC, an X-color coordinate Bx of about 0.135 and an Y-color coordinate By of about 0.005 that are constant according to the data voltage level DVL with respect to the blue sub-pixel. Although FIG. 8 illustrates an example where the red, green and blue color coordinates CC are constant according to the data voltage level DVL, in an exemplary embodiment, the data-RGB color coordinate information DAT_RGBCCI may include the red, green and blue color coordinates CC changed according to the data voltage level DVL. Further, in an exemplary embodiment, as illustrated in FIG. 9, a data-RGB luminance block 260 may store data-RGB luminance (or luminous efficiency) information DAT_RGBLI representing a plurality of red luminances (or red luminous efficiencies) 510 for the red sub-pixel, a plurality of green luminances (or green luminous efficiencies) 530 for the green sub-pixel and a plurality of blue luminances (or blue luminous efficiencies) 550 for the blue sub-pixel according to the data voltage level DVL. For example, the gray-voltage calculator 240 may determine a ratio of a red voltage level, a green voltage level and a blue voltage level having a color coordinate represented by the target white color coordinate TGT_WGC at each gray level based on the target white color coordinate TGT_WGC and the data-RGB color coordinate information DAT_RGBCCI, and may determine the red voltage level, the green voltage level and the blue voltage level having a luminance represented by the gray-luminance information GLI while maintaining the ratio at each gray level based on the gray-luminance information GLI and the data-RGB luminance information DAT_RGBLI.

A gray voltage generator 130 may read the gray-voltage information GVI from a gamma block 210, and may generate a plurality of gray voltages GV having the plurality of voltage levels represented by the gray-voltage information GVI at step S440. A data driver 140 may provide the plurality of gray voltages GV corresponding to output image data ODAT as data voltages DV to the plurality of pixels PX in the image display period at step S450, and may provide a black data voltage to the plurality of pixels PX in the black insertion period at step S460. Accordingly, even if the black duty ratio and/or the peak luminance PEAK_LUM is changed, an image displayed by the plurality of pixels PX in the image display period may have an average luminance corresponding to the target gamma value TGT_GAMMA.

Figure 10:
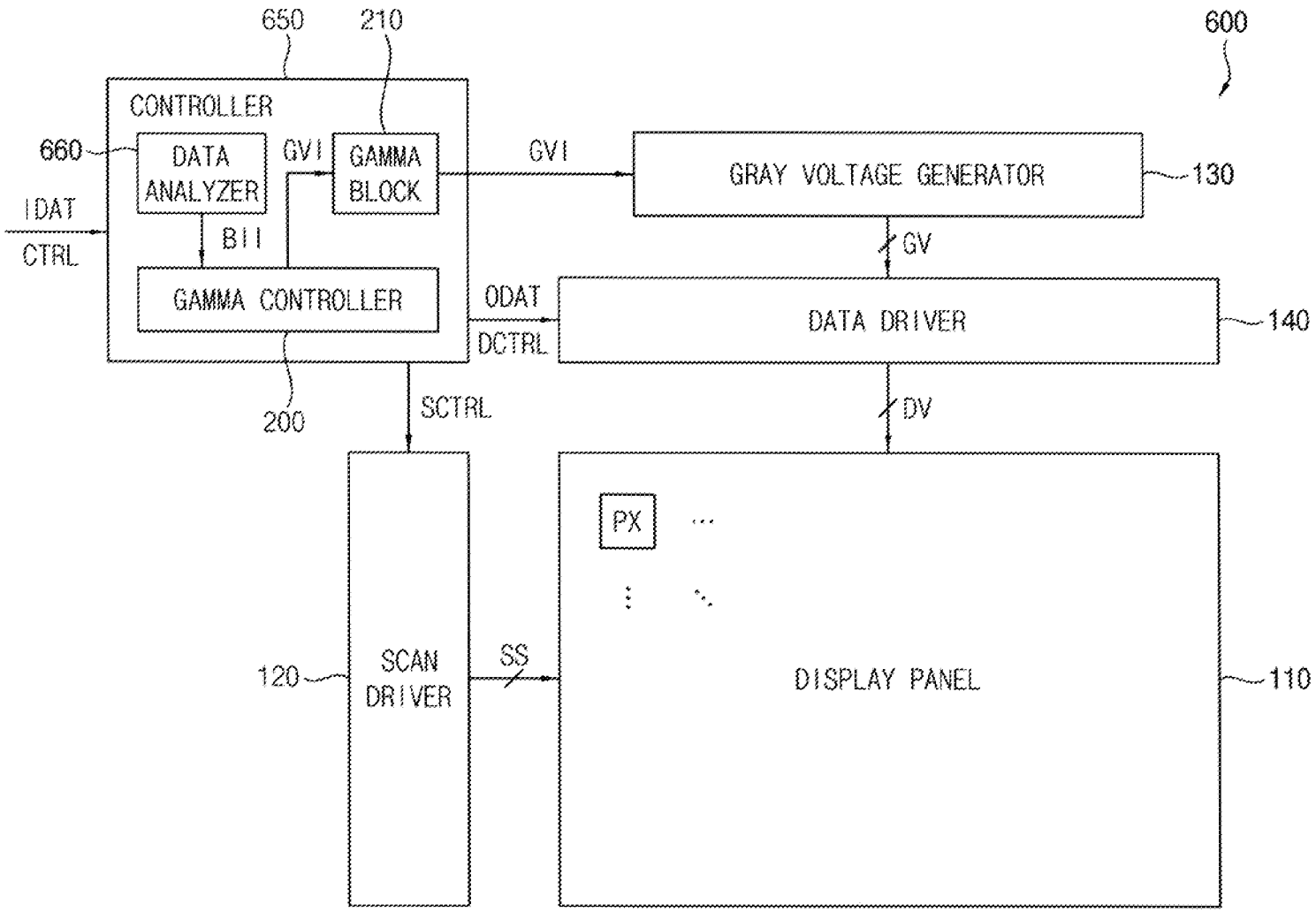
FIG. 10 is a block diagram illustrating a display device according to an exemplary embodiment.
Figure 11:
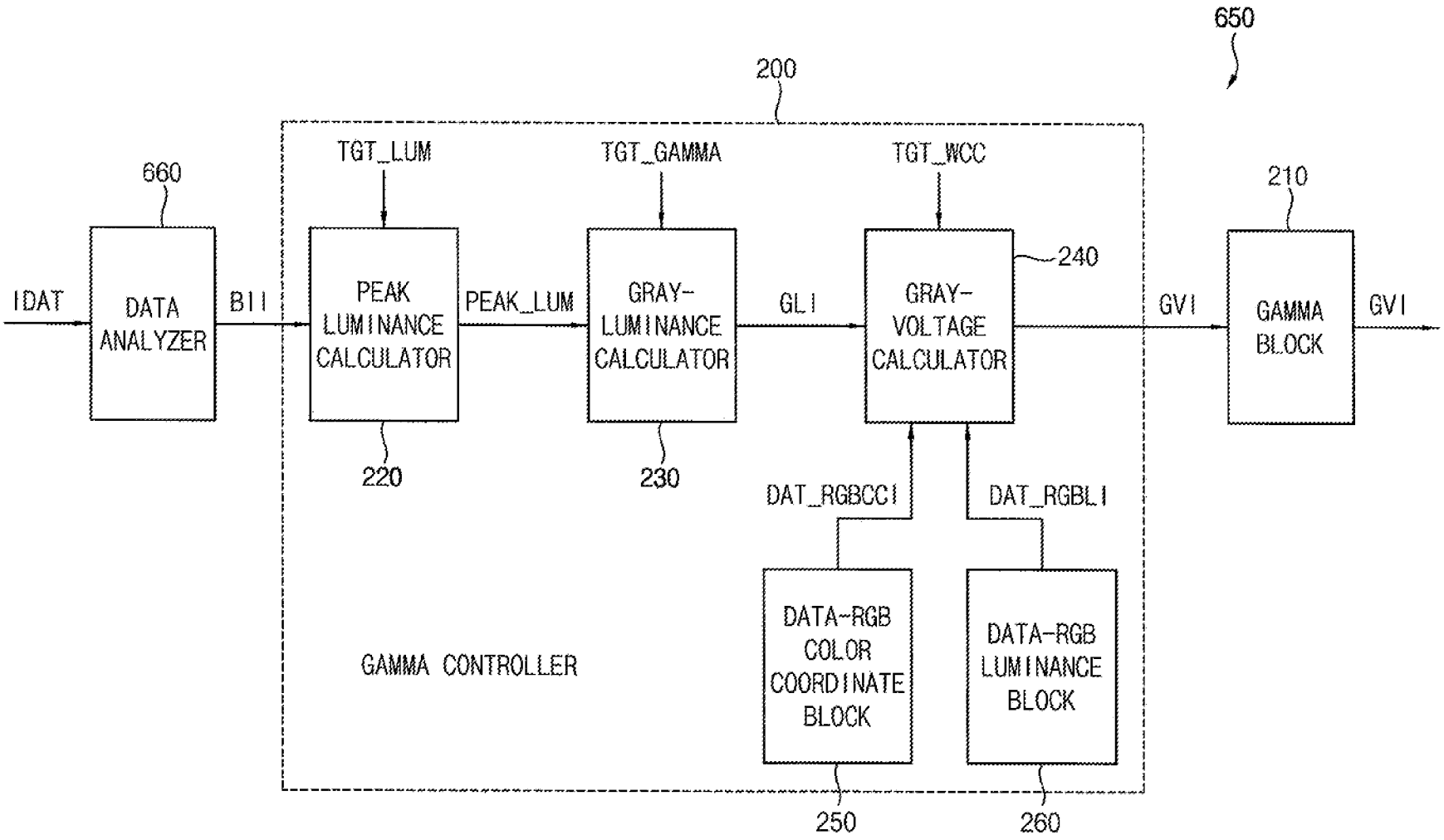
FIG. 11 is a block diagram illustrating an example of a controller included in a display device according to an exemplary embodiment.

FIG. 10 illustrates a display device according to an exemplary embodiment, and FIG. 11 illustrates an example of a controller included in a display device according to an exemplary embodiment.

Referring to FIGS. 10 and 11, a display device 600 according to an exemplary embodiment may include a display panel 110, a scan driver 120, a gray voltage generator 130, a data driver 140 and a controller 650. The controller 650 may include a data analyzer 660, a gamma controller 200 and a gamma block 210. The display device 600 of FIG. 10 may have a similar configuration and a similar operation to a display device 100 of FIG. 1, except that the controller 650 need not receive black insertion information BII from an external host, and may include the data analyzer 660 generating the black insertion information BII by analyzing input image data IDAT.

The data analyzer 660 may determine a black duty ratio that is a ratio of a black insertion period to a frame period, or a ratio of a black insertion period to a sum of an image display period and the black insertion period, by analyzing the input image data IDAT, and may generate the black insertion information BII representing the black duty ratio. In an exemplary embodiment, the data analyzer 660 may determine the black duty ratio by analyzing an amount of motion and/or data loading of the input image data IDAT. For example, as the amount of motion in the input image data IDAT increases, the data analyzer 660 may increase the black duty ratio.

A peak luminance calculator 220 may receive the black insertion information BII from the data analyzer 660, and may determine a peak luminance PEAK_LUM based on the black duty ratio and a target luminance TGT_LUM. A gray-luminance calculator 230 may determine gray-luminance information GLI based on the peak luminance PEAK_LUM and a target gamma value TGT_GAMMA. A gray-voltage calculator 240 may generate gray-voltage information GVI based on a target white color coordinate TGT_WGC, the gray-luminance information GLI, data-RGB color coordinate information DAT_RGBCCI and data-RGB luminance information DAT_RGBLI. The gray voltage generator 130 may generate a plurality of gray voltages GV based on the gray-voltage information GVI. Accordingly, even if the peak luminance PEAK_LUM is changed, the display device 600 according to an exemplary embodiment may have a constant gamma characteristic, or a gamma characteristic of the constant target gamma value TGT_GAMMA.

According to an exemplary embodiment, a display controller 650 includes a gamma controller circuit 200 having a peak luminance sub-circuit 220, a grayscale luminance sub-circuit 230 coupled to the peak luminance sub-circuit, and a grayscale voltage sub-circuit 240 coupled to the grayscale luminance sub-circuit; and a gamma storage circuit 210 coupled to the grayscale voltage sub-circuit of the gamma controller circuit. In an exemplary embodiment, the display controller 650 may include: a data color coordinate sub-circuit 250 coupled to the grayscale voltage sub-circuit; and a data luminance sub-circuit 260 coupled to the grayscale voltage sub-circuit.

In an exemplary embodiment, the display controller 650 may include: a data analyzer circuit 660 coupled to the gamma controller circuit. In an exemplary embodiment, the display controller may include: a grayscale voltage generator circuit 130 coupled to the gamma storage circuit 210. In an exemplary embodiment, the gamma controller circuit 200 may be configured to receive black insertion information based on input image data, and provide grayscale voltage information to the gamma storage circuit 210. In an exemplary embodiment, the gamma storage circuit 210 may include a lookup table having, for each of a plurality of grayscale voltage inputs, a plurality of different grayscale voltage outputs for a corresponding plurality of different peak luminance values.

Figure 12:
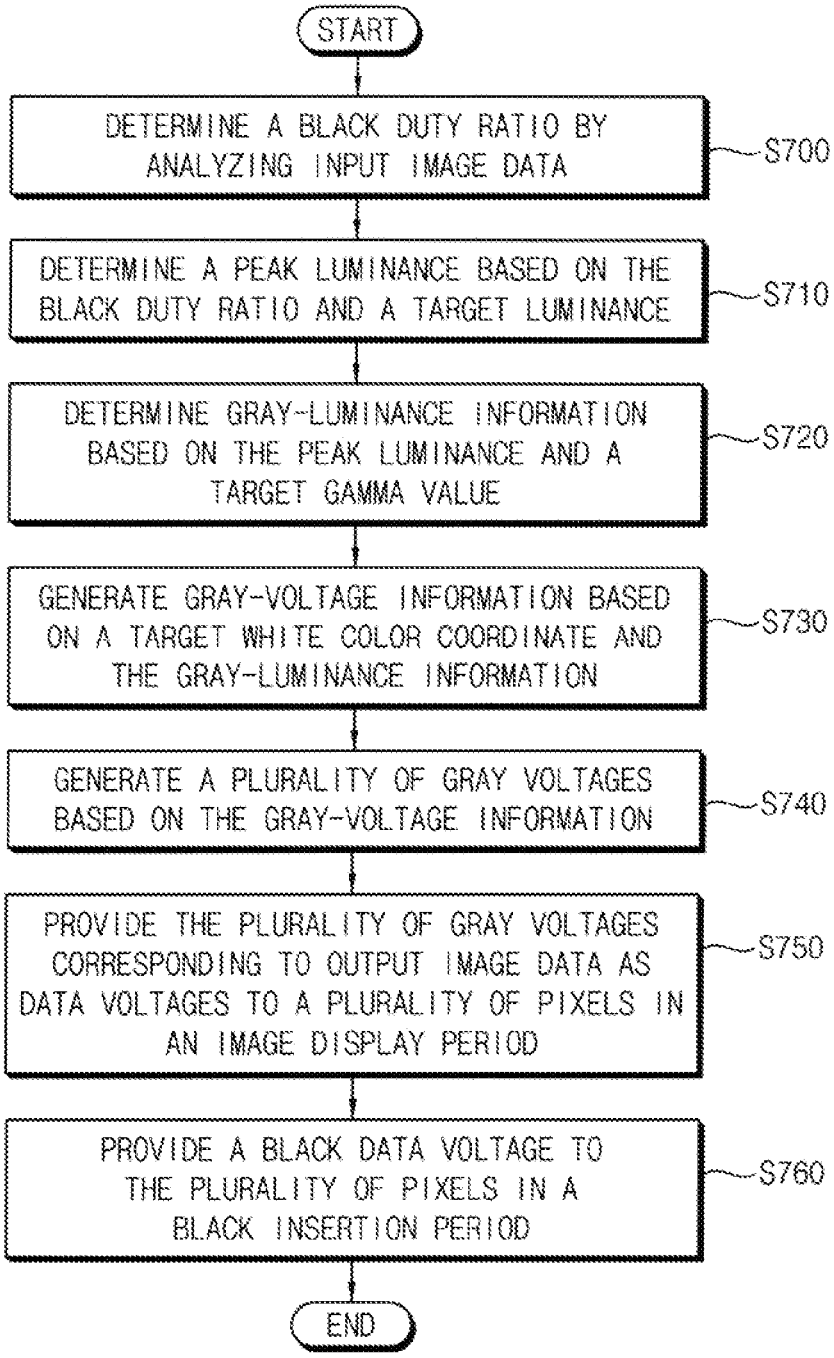
FIG. 12 is a flowchart diagram illustrating a method of operating a display device according to an exemplary embodiment.

FIG. 12 is a flowchart illustrating a method of operating a display device according to an exemplary embodiment.

Referring to FIGS. 10, 11 and 12, in a method of operating a display device 600 including a plurality of pixels PX, a data analyzer 660 may determine a black duty ratio that is a ratio of a black insertion period to a frame period, or a sum of an image display period and the black insertion period by analyzing input image data IDAT, and may generate black insertion information BII representing the black duty ratio at step S700.

A peak luminance calculator 220 may receive the black insertion information BII from the data analyzer 660, and may determine a peak luminance PEAK_LUM based on the black duty ratio represented by the black insertion information BII and a target luminance TGT_LUM at step S710. A gray-luminance calculator 230 may determine gray-luminance information GLI based on the peak luminance PEAK_LUM and a target gamma value TGT_GAMMA at step S720. A gray-voltage calculator 240 may generate gray-voltage information GVI based on a target white color coordinate TGT_WCC, the gray-luminance information GLI, data-RGB color coordinate information DAT_RGBCCI and data-RGB luminance information DAT_RGBLI at step S730. A gray voltage generator 130 may generate a plurality of gray voltages GV based on the gray-voltage information GVI at step S740. A data driver 140 may provide the plurality of gray voltages GV corresponding to output image data ODAT as data voltages DV to the plurality of pixels PX in the image display period at step S750, and may provide a black data voltage to the plurality of pixels PX in the black insertion period at step S760. Accordingly, even if the black duty ratio and/or the peak luminance PEAK_LUM is changed, an image displayed by the plurality of pixels PX in the image display period may have an average luminance corresponding to the target gamma value TGT_GAMMA.

Figure 13:
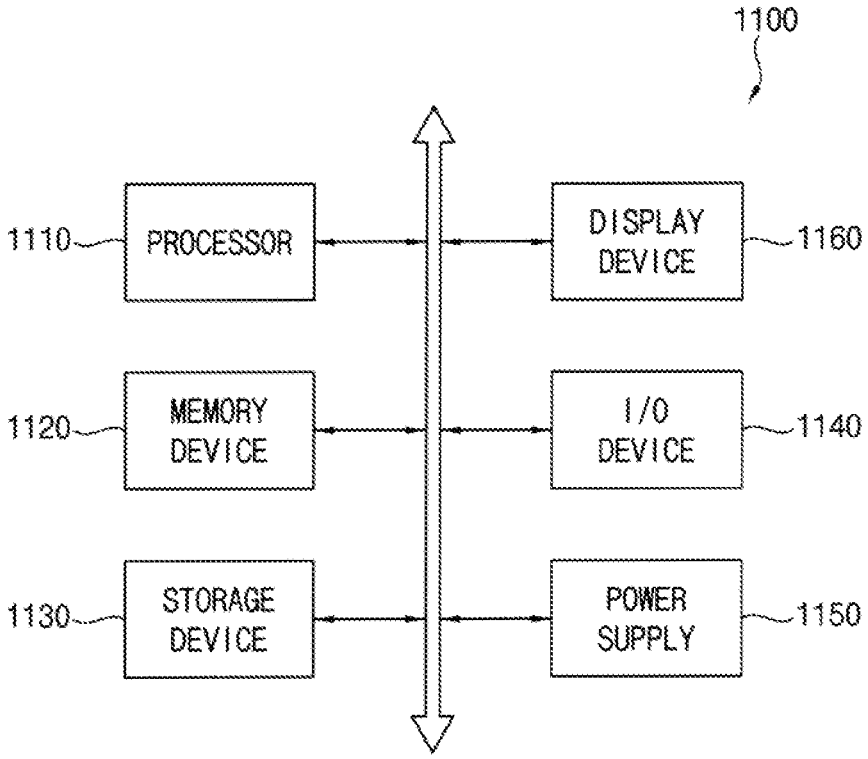
FIG. 13 is a block diagram illustrating an electronic device including a display device according to an exemplary embodiment.

FIG. 13 is a block diagram illustrating an electronic device including a display device according to an exemplary embodiment.

Referring to FIG. 13, an electronic device 1100 may include a processor 1110, a memory device 1120, a storage device 1130, an input/output (I/O) device 1140, a power supply 1150, and a display device 1160 such as the display device 100 of FIG. 1 or the display device 600 of FIG. 10. The electronic device 1100 may further include a plurality of ports for communicating a video card, a sound card, a memory card, a universal serial bus (USB) device, other electric devices, or the like.

The processor 1110 may perform various computing functions or tasks. The processor 1110 may be an application processor (AP), a micro processor, a central processing unit (CPU), or the like. The processor 1110 may be coupled to other components via an address bus, a control bus, a data bus, or the like. Further, in an exemplary embodiment, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, or the like, and/or at least one volatile memory device such as a dynamic random access memory (DRAM) device, a static random access memory (SRAM) device, a mobile dynamic random access memory (mobile DRAM) device, or the like.

The storage device 1130 may be a solid-state drive (SSD) device, a hard disk drive (HDD) device, a CD-ROM device, or the like. The I/O device 1140 may be an input device such as a keyboard, a keypad, a mouse, a touch screen, or the like, and an output device such as a printer, a speaker, or the like. The power supply 1150 may supply power for operations of the electronic device 1100. The display device 1160 may be coupled to other components through the buses or other communication links.

The display device 1160 may determine a peak luminance based on a black duty ratio and a target luminance, may determine gray-luminance information based on the peak luminance and a target gamma value, may generate gray-voltage information based on a target white color coordinate and the gray-luminance information, and may generate a plurality of gray voltages based on the gray-voltage information. Accordingly, even if the peak luminance is changed, the display device 1160 according to an exemplary embodiment may have a constant gamma characteristic, or a gamma characteristic of the constant target gamma value.

The inventive concepts may be applied to any display device 1160, and any electronic device 1100 including the display device 1160. For example, the inventive concepts may be applied to a mobile phone, a smart phone, a tablet computer, a wearable electronic device, a virtual reality (VR) device, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, or the like.

Although exemplary embodiments have been described, those of ordinary skill in the pertinent art will readily appreciate that many modifications are possible in the exemplary embodiments without materially departing from scope or spirit of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other embodiments, are intended to be included within the scope of the appended claims.

What is claimed is:

1. A display device comprising:

a display panel including a plurality of pixels;

a controller configured to determine a peak luminance based on a target luminance and a black insertion period, to determine gray-luminance information representing a plurality of luminances respectively corresponding to a plurality of gray levels based on the peak luminance and a target gamma value, and to generate gray-voltage information representing a plurality of voltage levels respectively corresponding to the plurality of gray levels based on a target white color coordinate and the gray-luminance information;

a gray voltage generator configured to generate a plurality of gray voltages having the plurality of voltage levels based on the gray-voltage information; and a data driver configured to provide the plurality of gray voltages corresponding to output image data as data voltages to the plurality of pixels in an image display period, and to provide a black data voltage to the plurality of pixels in the black insertion period.

2. The display device of claim 1, wherein the plurality of pixels displays an image with a luminance corresponding to the target gamma value in the image display period.

3. The display device of claim 1, wherein the controller includes:

a peak luminance calculator configured to determine the peak luminance based on the target luminance and a black duty ratio that is a ratio of the black insertion period to a sum of the image display period and the black insertion period;

a gray-luminance calculator configured to determine the gray-luminance information based on the peak luminance and the target gamma value;

a gray-voltage calculator configured to generate the gray-voltage information based on the target white color coordinate and the gray-luminance information; and a gamma block configured to store the gray-voltage information.

4. The display device of claim 3, wherein the peak luminance calculator calculates the peak luminance by using an equation, "PEAK_LUM=TGT_LUM/(1−BDR)", where PEAK_LUM represents the peak luminance, TGT_LUM represents the target luminance, and BDR represents the black duty ratio.

5. The display device of claim 3, wherein the peak luminance calculator receives black insertion information representing the black duty ratio from an external host.

6. The display device of claim 3, wherein the controller further includes:

a data analyzer configured to determine the black duty ratio by analyzing input image data, and to generate black insertion information representing the black duty ratio, and wherein the peak luminance calculator receives the black insertion information from the data analyzer.

7. The display device of claim 3, wherein the gray-luminance calculator calculates the plurality of luminances respectively corresponding to the plurality of gray levels by using an equation, "GRAY_LUM=PEAK_LUM*(GRAY/MAX_GRAY)^TGT_GAMMA", where GRAY_LUM represents the plurality of luminances respectively corresponding to the plurality of gray levels, PEAK_LUM represents the peak luminance, GRAY represents the plurality of gray levels, MAX_GRAY represents a maximum gray level, and TGT_GAMMA represents the target gamma value.

8. The display device of claim 3, wherein each of the plurality of pixels includes a red sub-pixel, a green sub-pixel and a blue sub-pixel, and wherein the gray-voltage calculator determines a plurality of red voltage levels for the red sub-pixel, a plurality of green voltage levels for the green sub-pixel and a plurality of blue voltage levels for the blue sub-pixel at the plurality of gray levels based on the target white color coordinate and the gray-luminance information.

9. The display device of claim 8, wherein the controller further includes:

a data-RGB color coordinate block configured to store data-RGB color coordinate information representing a plurality of red color coordinates for the red sub-pixel, a plurality of green color coordinates for the green sub-pixel and a plurality of blue color coordinates for the blue sub-pixel at a plurality of data voltage levels; and a data-RGB luminance block configured to store data-RGB luminance information representing a plurality of red luminances for the red sub-pixel, a plurality of green luminances for the green sub-pixel and a plurality of blue luminances for the blue sub-pixel at the plurality of data voltage levels.

10. The display device of claim 9, wherein the gray-voltage calculator determines the plurality of red voltage levels, the plurality of green voltage levels and the plurality of blue voltage levels at the plurality of gray levels based on the target white color coordinate, the gray-luminance information, the data-RGB color coordinate information and the data-RGB luminance information, and writes the gray-voltage information representing the plurality of red voltage levels, the plurality of green voltage levels and the plurality of blue voltage levels at the plurality of gray levels to the gamma block.

11. The display device of claim 3, wherein the gray voltage generator reads the gray-voltage information from the gamma block, and generates the plurality of gray voltages having the plurality of voltage levels represented by the gray-voltage information.

12. The display device of claim 1, wherein the black data voltage is one of the plurality of gray voltages corresponding to a minimum gray level.

13. A method of operating a display device including a plurality of pixels, the method comprising:

determining a peak luminance based on a target luminance and a black insertion period;

determining gray-luminance information representing a plurality of luminances respectively corresponding to a plurality of gray levels based on the peak luminance and a target gamma value;

generating gray-voltage information representing a plurality of voltage levels respectively corresponding to the plurality of gray levels based on a target white color coordinate and the gray-luminance information;

generating a plurality of gray voltages having the plurality of voltage levels based on the gray-voltage information;

providing the plurality of gray voltages corresponding to output image data as data voltages to the plurality of pixels in an image display period; and providing a black data voltage to the plurality of pixels in the black insertion period.

14. The method of claim 13, wherein determining the peak luminance based on the target luminance and the black insertion period includes:

calculating the peak luminance by using an equation, "PEAK_LUM=TGT_LUM/(1−BDR)", where PEAK_LUM represents the peak luminance, TGT_LUM represents the target luminance, and BDR represents a black duty ratio that is a ratio of the black insertion period to a sum of the image display period and the black insertion period.

15. A display controller comprising:

a gamma controller circuit having a peak luminance sub-circuit, a grayscale luminance sub-circuit coupled to the peak luminance sub-circuit, and a grayscale voltage sub-circuit coupled to the grayscale luminance sub-circuit; and a gamma storage circuit coupled to the grayscale voltage sub-circuit of the gamma controller circuit.

16. The display controller of claim 15, further comprising:

a data color coordinate sub-circuit coupled to the grayscale voltage sub-circuit; and a data luminance sub-circuit coupled to the grayscale voltage sub-circuit.

17. The display controller of claim 15, further comprising:

a data analyzer circuit coupled to the gamma controller circuit.

18. The display controller of claim 15, further comprising:

a grayscale voltage generator circuit coupled to the gamma storage circuit.

19. The display controller of claim 15, wherein:

the gamma controller circuit is configured to receive black insertion information based on input image data, and provide grayscale voltage information to the gamma storage circuit.

20. The display controller of claim 15, wherein:

the gamma storage circuit comprises a lookup table including, for each of a plurality of grayscale voltage inputs, a plurality of different grayscale voltage outputs for a corresponding plurality of different peak luminance values.

* * * * *